US005273291A

United States Patent [19]

Giannetti

[11] Patent Number: 5,273,291

[45] Date of Patent: Dec. 28, 1993

[54] TARGET RANGE APPARATUS FOR BOW HUNTERS

[75] Inventor: Nickolas J. Giannetti, Pleasant Mountain, Pa.

[73] Assignee: Archery Visions, Inc., Pleasant Mount, Pa.

[21] Appl. No.: 37,365

[22] Filed: Mar. 26, 1993

[51] Int. Cl.[5] ..... F41J 3/00; F41J 5/10

[52] U.S. Cl. ..... 273/358; 273/409

[58] Field of Search ..... 273/358, 403, 407, 408, 273/409

[56] References Cited

U.S. PATENT DOCUMENTS

| | | | |
|---|---|---|---|
| 2,090,930 | 8/1937 | Chubb | 273/408 |
| 3,409,300 | 5/1968 | Rockwood | 273/409 |
| 3,697,073 | 10/1972 | Dooley | 273/358 |

*Primary Examiner*—Benjamin H. Layno
*Attorney, Agent, or Firm*—Charles I. Brodsky

[57] ABSTRACT

The apparatus displays successive pictures of different-type game animals on a screen, preferably each for a predetermined interval of time. The bowman releases an arrow in an attempt to strike the heart or lung of each animal while its picture is being displayed. A scoring target overlies the screen and is imprinted with the heart and lung area identified for each animal, and in positional correlation with its displayed picture. Each arrow released is similarly identified so that after all arrows are released, the target can be inspected to establish a scoring accuracy of the bowman, by comparing each identified arrow with each heart and lung area aimed at.

10 Claims, 1 Drawing Sheet

TARGET RANGE APPARATUS FOR BOW HUNTERS

FIELD OF THE INVENTION

This invention relates to target range apparatus for bow hunters and, more particularly, to such apparatus as may be used for target practice, beyond just aiming at a bulls-eye.

BACKGROUND OF THE INVENTION

As is well known and understood, specific periods of time are established each year for the bow-hunting of different-type game animals. As will be appreciated, bowman of all ages approach such hunting season with anxiety brought about by a general inability to practice effectively during the rest of the year, and because just shooting at bulls-eye targets is not really representative of what the bowman would encounter when out in the woods. When one further considers that the hunting would be of different size animals—e.g., deer, bear, moose, elk, and even the wild animals of Africa, etc.—, it would also be apparent that some method of practicing a target shoot would be desirable for aiming at different vital area locations, as the hearts and lungs of these animals appear at quite different locations, because of their size. When it is further appreciated that the bowman only has split-seconds of time to aim and release an arrow, it will be further apparent how a different type of target shooting system would be desirable, instead of the stationery target of a tree, a bail of hay, or the bulls-eye that the bowman nowadays has to practice with. And, clearly, any type of target shoot, to gauge one's performance over time, should have some easy scoring method as part of it, both for purposes of enjoyment and for ease in comparing one's progress and skill over time.

SUMMARY OF THE INVENTION

As will become clear hereinafter, these objectives are satisfied by the target range apparatus of the invention which will be seen to display successive pictures of different-type game animals on a screen, preferably each for a predetermined interval of time. The bowman, upon seeing the displayed picture, then releases an arrow in an attempt to strike the heart or lung of each animal while its picture is being displayed. A scoring target will be seen to be included, overlying the screen, and being imprinted with the heart and lung area identified for each animal, and in positional correlation with its displayed picture so that these vital areas are located on the target behind where they would appear on the animal shown. Each arrow released, according to the invention, will be seen to be similarly identified, so that after all arrows are released, the target can be inspected to establish a scoring accuracy by comparing each identified arrow with each heart and lung area aimed at. As will also become clear, in a preferred embodiment of the invention, the scoring target is faintly imprinted with the heart and lung area for each animal, so as to be indiscernible to the bowman standing away from the screen, and yet sufficiently discernible for inspecting to determine scoring accuracy after the arrows have been shot.

BRIEF DESCRIPTION OF THE DRAWING

These and other features of the present invention will be more clearly understood from a consideration of the following description, in which.

DETAILED DESCRIPTION OF THE DRAWING

Figure 1:
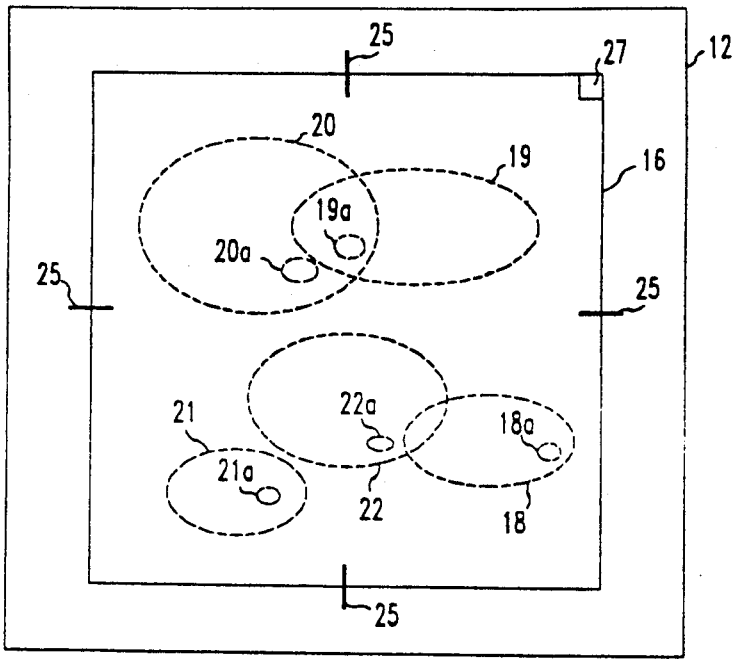
FIG. 1 illustrates an embodiment of a scoring target overlying a screen on which the picture of the game animal is displayed, according to the invention.

In the Drawing, a picture of a game animal 10 is displayed on a screen 12, for example by means of a slide projector 14 located a distance of some 12–15 feet away. Overlying the screen 12 is a scoring target 16 imprinted with the heart and lung area identified for that animal, and for others that might be successively projected onto the screen 12—and illustratively shown in FIG. 1 for 5 displayed game animal pictures. Thus, and referring to FIG. 2 in more detail, the larger areas 18, 19, 20, 21, 22 might represent the "lung" area for each of five successive animal displays, while the smaller areas 18*a*, 19*a*, 20*a*, 21*a* and 22*a* might reflect the "heart" locations when that picture is projected. A plurality of alignment markers 25 coordinate the placement of the scoring target 16 onto the screen 12 in this manner, such that when a first animal picture is projected onto the screen 12, the areas 18 and 18*a* on the scoring target fall in proper position with the location of the "lung" and "heart" areas of the illuminated animal. In similar manner, when a second picture of a different game animal is projected onto the screen 12, the areas 19 and 19*a* fall behind the projection, in proper position where the "lung" and "heart" areas of that animal might fall. Similarly, with respect to the third, fourth and fifth projected picture of a typical five animal-type display, the areas 20 and 20*a*, 21 and 21*a*, and 22 and 22*a* all appear behind those areas of the projected animal where its "lung" and "heart" would exist in real life. In accordance with the invention, all these target areas 18–18*a*, 19–19*a*, etc. are faintly imprinted onto the scoring target 16, so as not to be discernible to the bowman standing away from the screen and aiming an arrow there at, but yet sufficiently discernible for inspecting to determine scoring accuracy after an arrow has been released into the screen. Reference numeral 27 on the target screen 16 identifies that target screen as being the one including these vital heart and lung areas for the first five of successive pictures displayed of game animals by the projector 14, whereas a second grouping of five successive pictures displayed by the projector would generally require a different set of vital area locations, as would appear on a second target screen, identified by a different reference numeral at the upper righthand corner of the target.

In a preferred construction of the invention, the screen 12 and the scoring target 16 were composed of a light reflective materials, with the scoring target 16 being of a white cardboard. In such embodiment, a 4'×4' cardboard was found quite appropriate.

Figure 2:
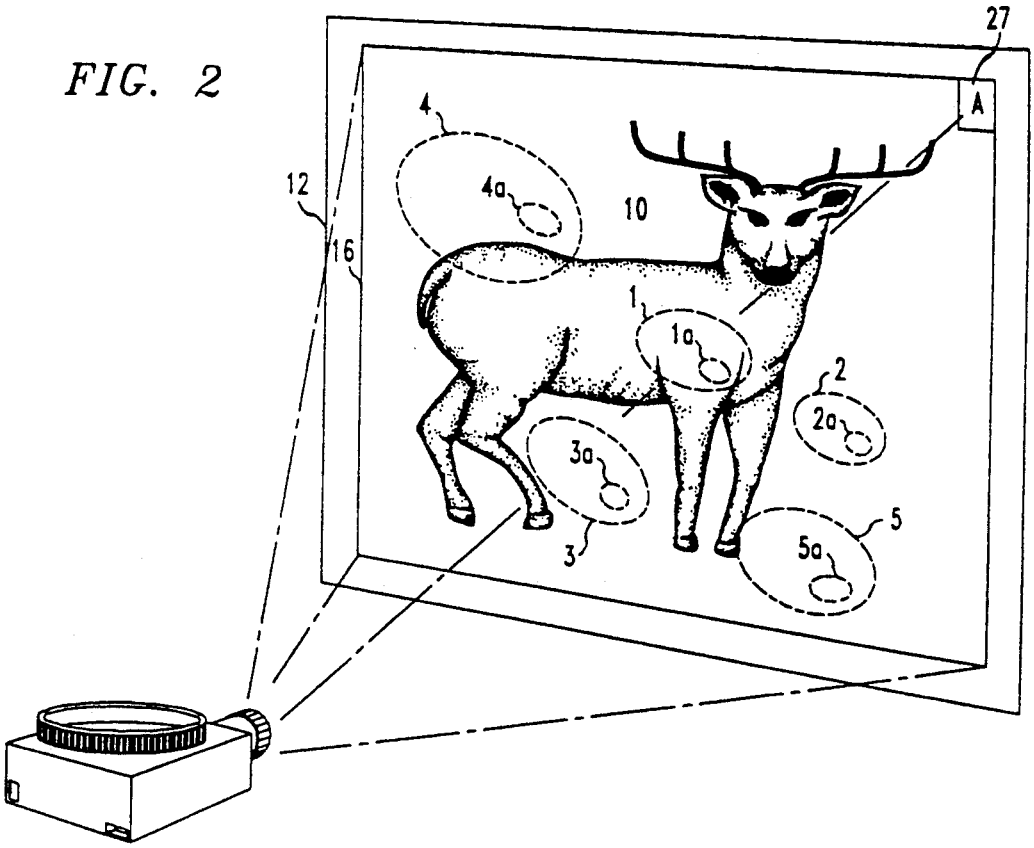
FIG. 2 is helpful in an understanding as to how the target range apparatus embodying the invention may be utilized as a practice tool by a bow hunter.

FIG. 2 displays a scoring target 16 different from that illustrated in FIG. 1, and also shows how the game animal would have its picture displayed on the screen 12. Although the five vital "lung" and "heart" areas are shown, it will be understood that, as described above, such areas are not observable to the practicing bowman, who only sees the picture of the displayed animal. In this FIGURE, such vital areas are shown solely for purposes of understanding the operation of the invention.

Thus, and acknowledging that the target screen 16 of FIG. 2, identified as A by the reference numeral 27 is to be used for displaying the vital target areas for animal pictures one through five, such "vital areas" for the lungs and heart would underlie the first animal picture there shown 10 by the reference numerals 1 and 1*a*, respectively. (For the second, third, fourth and fifth animal pictures to be displayed thereafter, these vital "lung" and "heart" vital areas are indicated as 2 and 2*a*, 3 and 3*a*, 4 and 4*a*, and 5 and 5*a*, respectively, once those pictures are later projected.)

However, as far as the practicing bowman is concerned, the animal display 10 is projected, and the bowman is given a set period of time to release an arrow at the vital area of the displayed animal while the picture continues to show on the screen. In one use of the invention, as an example, after the arrow has been readied on the bow, the picture may be displayed for approximately five second, during which time the bowman is to shoot. For this first picture, the bowman would release an arrow typically numbered "one" to correspond to this animal display. Then, once the bowman has readied an arrow #2, a second animal picture is displayed, at which time the bowman releases that arrow at either the "lung" or "heart" vital area 2 or 2*a* of FIG. 2—continuing the process for arrow numbered 3, 4, 5 as the third, fourth and fifth picture display is projected, with the bowman then releasing the arrow towards the respective ones of the vital areas 3, 3*a* or 4, 4*a* or 5, 5*a* that the arrows are aimed at.

After all the arrows are released at the scoring target 16, one needs only to compare the arrow #1 stuck into the scoring target 16 with the location of the vital "lung" area 1 or vital "heart" area 1*a*, to determine the accuracy of the shot. The same approach is followed by comparing the location in the scoring target 16 of arrow #2, with the "lung" and "heart" area locations 2, 2*a*, respectively. In scoring, any available system may be used, such as assigning 100 points for an arrow location consistent with the "heart" area aimed at for that animal, 50 points for an arrow in the appropriate "lung" area, and 0 points for anything else. Testing of the described apparatus has shown that a five second interval is usually sufficient for the bowman to aim and release the arrow at the target—and, for such reason, it would be possible to program the projector 14 so as to display each animal for that five second interval, with a set period inbetween to allow for the archer to reach for, and fit a further arrow onto the bow. With one such automatic programming for a typical five-slide display-and-shoot, the bowman can simply measure the score obtained, remove the five arrows shot, and replace the scoring target 16 with the next one, to practice with a further display of different game-type animals—be it a repetition of the first five, a totally different set of five displays, or a mixture of used animals pictures and new ones. Obviously, fewer or more sets of vital areas can be incorporated on each scoring target, as desired; and the shapes and/or locations of the vital areas can be chosen as desired, to offer a realistic target practice range consistent with what the hunter would find in the woods, fields or forests when actually tracking the animal.

And, obviously, as an aside to practicing the shooting technique, such apparatus also educates the bowman where the vital areas of any one of the displayed animals are located, to facilitate a greater kill-efficiency when actually out in the hunt.

While there have been described what are considered to be preferred embodiments of the present invention, it will be apparent to those skilled in the art that modifications can be made without departing from the scope of the teachings herein. Whether cardboard, or square, clearly different scoring targets may be employed, and for fewer or greater target displays, as desired. For at least such reasons, therefore, resort should be had to the claims appended hereto for a true understanding of the scope of the invention.

I claim:

1. Target range apparatus for bow hunters comprising: a screen; means for displaying successive pictures of different-type game animals on said screen; a scoring target overlying said screen, imprinted with the heart and lung area identified for each animal and in positional correlation with its displayed picture; a plurality of arrows equal in number to the number of successive pictures displayed, and with each of said plurality of arrows identified with each picture displayed; and wherein, after all arrows are released by a bowman in attempting to strike the heart or lung of each animal while its picture is being displayed, said target can be inspected to establish a scoring accuracy by comparing each identified arrow with each heart and lung area aimed at.

2. The apparatus of claim 1 wherein said means for displaying successive pictures of different-type game animals includes a slide projector.

3. The apparatus of claim 2, wherein said slide projector is placed a distance between 12 and 15 feet from said screen.

4. The apparatus of claim 1 wherein each of said screen and said scoring target are composed of a light reflective material.

5. The apparatus of claim 4 wherein said scoring target is composed of a white cardboard material.

6. The apparatus of claim 4 wherein said scoring target is in the configuration of a "square", 4 feet on a side.

7. The apparatus of claim 1 wherein each of said screen and said scoring target incorporate means for positioning the alignment of said target to overlie said screen.

8. The apparatus of claim 1 wherein said scoring target is faintly imprinted with said head and lung area for each animal so as to be substantially indiscernible to a bowman standing away from said screen and aiming there at, and yet discernible for inspection to determine scoring accuracy.

9. The apparatus of claim 1 wherein said means displays successive pictures of different-type game animals on said screen for a predetermined interval of time.

10. The apparatus of claim 9 wherein said means displays successive pictures of different-type game animals for substantially a five second interval.

* * * * *